United States Patent [19]

Backes

[11] 3,944,318

[45] Mar. 16, 1976

[54] BATTERY POST AND CABLE CLAMP

[76] Inventor: William P. Backes, 2817 Grennell St., Peoria, Ill. 61605

[22] Filed: Dec. 2, 1974

[21] Appl. No.: 528,891

[52] U.S. Cl. ..... 339/231; 339/235

[51] Int. Cl.[2] ..... H01R 11/26

[58] Field of Search ..... 339/224–240

[56] References Cited

UNITED STATES PATENTS

| | | | |
|---|---|---|---|
| 1,961,113 | 5/1934 | Taylor et al. | 339/235 X |
| 2,070,259 | 2/1937 | Cremer | 339/235 |
| 2,729,802 | 1/1956 | Jordan et al. | 339/251 X |
| 2,755,454 | 7/1956 | Rogoff | 339/231 |

FOREIGN PATENTS OR APPLICATIONS

| | | | |
|---|---|---|---|
| 454,712 | 2/1949 | Canada | 339/235 |

*Primary Examiner*—Roy Lake
*Assistant Examiner*—E. F. Desmond

[57] ABSTRACT

A battery post and cable clamp intended for use with a conventional post of a conventional storage battery of the type used in vehicles, boats and the like, the clamp consisting of two separate parts which engage in a hinge manner at one end to be pivotable relative to each other and have a bolt adjustably securing the opposite ends together, each of the members having a semi-circular recess disposed therein with the recesses brought into registration when the members are hingedly affixed together so as to define a circular recess of a size adapted to be adjustably fit onto the conventional cylindrical battery post with the bolt adjustably fastening the clamp thereto, and with one of the members including a hollow cylindrical socket adapted to receive one end of a conductor cable therein and having a threaded bolt which is threadedly received through a side wall of the socket to retain the conductor cable affixed thereto.

3 Claims, 4 Drawing Figures

BATTERY POST AND CABLE CLAMP

BACKGROUND OF THE INVENTION

1. Field of the Invention

This invention relates generally to battery accessories and more particularly to a novel and improved battery post and cable clamp for affixing a conducting cable to the battery post in a manner permitting ease of removal of the clamp from the post.

2. Description of the Prior Art

It has been known in the prior art to provide different types of clamps for securing to battery posts, the clamps having one end of a battery conductor cable secured thereto. The majority of such clamps are made of one piece of lead like material which encircles the post and which is then bolted in place. However, due to the effects of corrosion and the lack of resiliency of the lead like material, such battery terminal clamps are normally quite difficult to remove from the battery posts when it comes time to change or service the battery. This becomes a major problem on those batteries which must be frequently removed from the device on which they are mounted, such as in the case of boats where batteries are frequently removed during periods of storage of the boat and then reinstalled during periods of use of the boat.

SUMMARY OF THE INVENTION

The present invention recognizes the deficiencies and disadvantages of presently available battery clamps when having to be frequently removed and reinstalled onto the battery posts of a battery, and provides a novel solution thereto in the form of a two piece battery clamp which is easily installed onto and removed from a battery terminal post with no damage to the post or to the clamp and requiring no special tools or expertise to accomplish the removal and reinstallation.

It is a feature of the present invention to provide a battery post and cable clamp.

A further feature of the present invention provides a battery post and cable clamp which is relatively simple in its construction and which therefore may be readily manufactured at a relatively low cost and by simple manufacturing methods such that it can be retailed at a sufficiently low price to encourage widespread use thereof.

Still a further feature of the present invention provides a battery clamp which is possessed of only two parts and which therefore is unlikely to get out of order.

Yet still a further feature of the present invention provides a battery post and cable clamp which is of a rugged and durable construction and which therefore may be guaranteed by the manufacturer to withstand many years of intended usage.

Still yet a further feature of the present invention provides a battery post and cable clamp which is easy to use and reliable and efficient in operation.

Other features and advantages of this invention will be apparent during the course of the following description.

BRIEF DESCRIPTION OF THE DRAWINGS

In the accompanying drawings forming a part of this specification, and in which like reference characters are employed to designate like parts throughout the same.

DESCRIPTION OF THE PREFERRED EMBODIMENT

Figure 1:
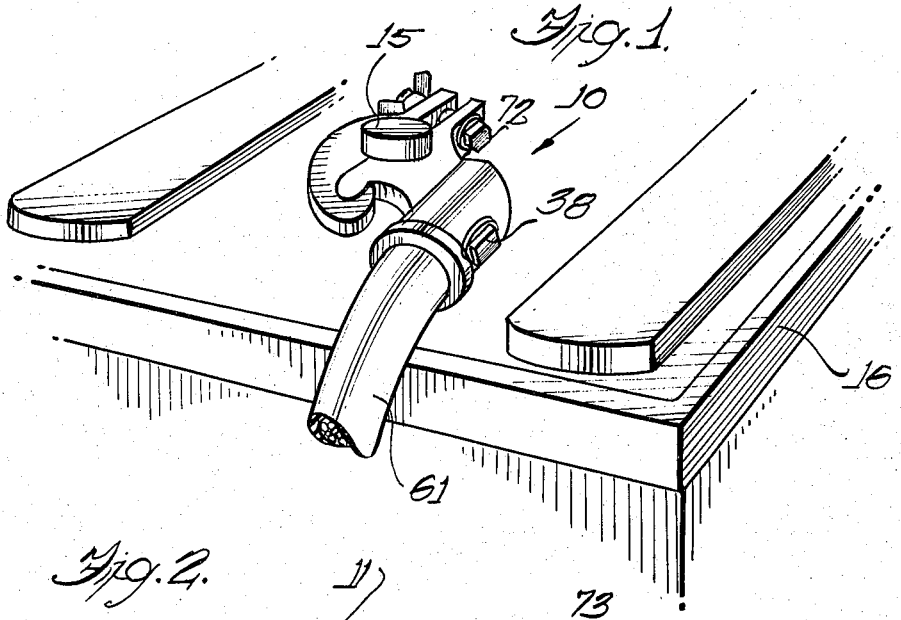
FIG. 1 is a perspective view of the battery post and cable clamp of the present invention as affixed to a conventional battery post.
Figure 2:
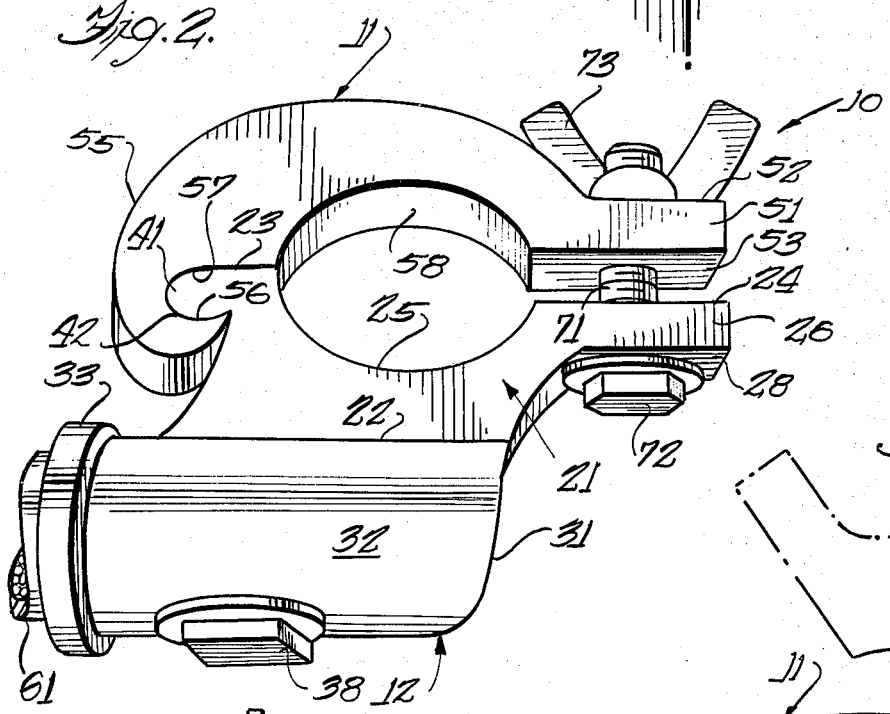
FIG. 2 is a top perspective view of the battery post and cable clamp of the invention.

Referring now to the drawings in detail there is illustrated a preferred form of a battery post and cable clamp constructed in accordance with the principles of the present invention and which is designated generally in its entirety by the reference numeral 10 and which is comprised of two component parts, namely a top member 11 and a bottom member 12. The clamp 10 may be manufactured of any suitable electrical conducting material, either ferrous or non-ferrous metallic material, with the preferred embodiment being manufactured of a corrosion resistant cast metal material.

The bottom member 12 includes a flat top portion 21 having a base 22 and a top edge 23 and an intermediate top edge 24 which is spaced closer to base 22 than top edge 23, there being disposed imtermediate adjacentmost ends of the edges 23 and 24 a semi-circular recess 25 of a diameter adapted to pass about the conventional battery post 15 of a storage type battery 16 of the type used in vehicles, boats and the like.

Intermediate top edge 24 is associated with lip 26 which projects outwardly of the recess 25 and has extending therethrough in a normal direction a bore 27 which extends from the bottom surface 28 through to the intermediate top edge 24.

Formed integrally with base 22 and extending parallel to edges 24 and 23 is a cylindrical socket forming member having a closed back end 31, cylindrical side walls 32, and an open front end 33 which provides access therethrough to cylindrical socket 34 defined interiorly thereof, the open front end 33 projects in the opposite direction from lip 26.

A threaded aperture 37 extends radially into socket 34 intermediate front and back ends 33 and 31 and receives therein the threaded shank of a bolt 38 having the terminal end thereof inserted into the socket 34.

Disposed adjacent the outermost portion of top edge 23 projecting outwardly in an opposite direction from lip 26 is a flange 41 having an arcuate bottom surface 42.

The top member 11 is manufactured of the same material as the bottom member 21 and is generally of a question mark configuration having a lip forming bottom end portion 51 having a flat top surface 52 and a flat bottom surface with a bore 54 extending therethrough between such surfaces, and an arcuate top end portion having arcuate exterior surface 55 which curves about to define an arcuate interior surface 56 of a curvature complementary to surface 42 of bottom member 12, and a flat bottom edge 57 complementary to flat top edge 23. Disposed intermediate flat bottom edge 57 and bottom surface 53 of lip 51 is a semi-circular recess 58 of the same curvature as recess 25.

Figure 3:
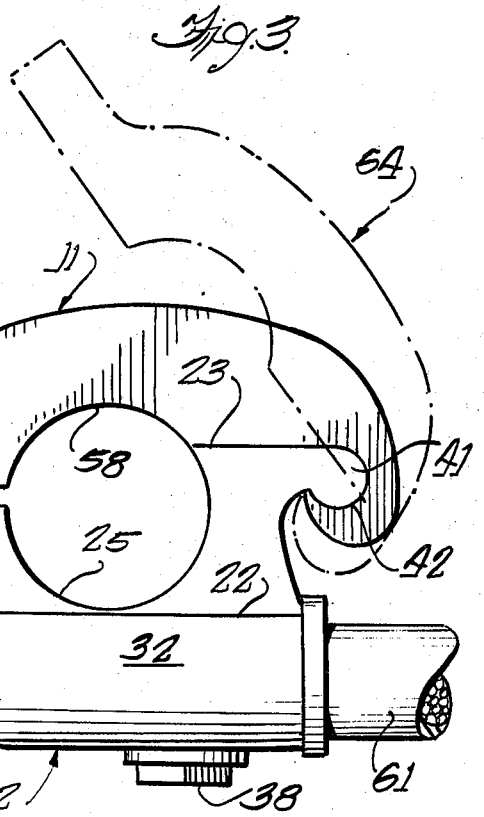
FIG. 3 is a top plan view of the battery post and cable clamp of the invention illustrated in the closed position and with phantom line indication of the clamp in the open position.
Figure 4:
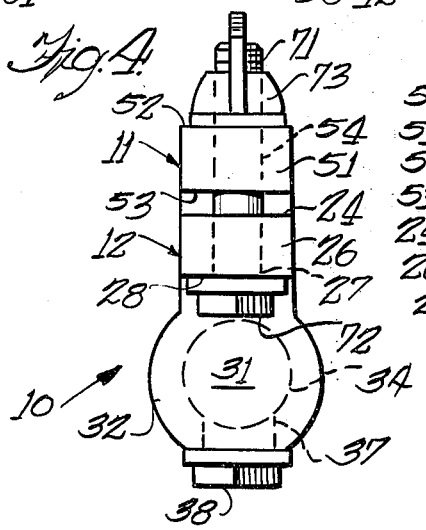
FIG. 4 is a left side elevational view of the battery clamp of FIG. 3.

In operation, a battery conductor cable 61 is inserted into socket 34 and secured therein by bolt 38 to be in electrical communication with the bottom member 12. The curved hook forming portion 56 and 57 of top member 11 is then engaged on the arcuate flange 41 about the arcuate portion 42 thereof in a manner providing a hinge like action thereabout, such as illustrated in FIG. 3 by phantom line configuration 64. The device is then placed about conventional battery post 15 which is received in the confronting disposed recesses 25 and 58, after which the threaded shank 71 of bolt 72 is passed through the aligned bores 27 and 54 with the bolt head engaging bottom surface 28 and with the terminal end of the shank 71 and projecting beyond top surface 52 and having a wing nut 73 threadedly received thereon for adjustably securing the clamp device 10 to the battery post 15.

It is to be understood that the operation of top member 11 relative to bottom member 12 about flange 51 is of a hinge-like interlocking manner such that the clamp can be readily removed, even when badly corroded or broken, from the battery post without having to pry or pull the battery clamp therefrom as is required in the removal of conventional clamps from the post, this thus eliminating any chance of breakage or damaging the battery post.

It is to be understood that the form of this invention herewith shown and described is to be taken as a preferred example of the same, and that this invention is not to be limited to the exact arrangement of parts shown in the accompanying drawings or described in this specification as various changes in the details of construction as to shape, size, and arrangement of parts may be resorted to without departing from the spirit of the invention, the scope of the novel concepts thereof, or the scope of the sub-joined claims.

Having thus described the invention, what is claimed is:

1. A battery post and cable clamp intended for securing a conductor cable to a conventional cylindrically configured battery post, the clamp device comprising, in combination:

a bottom clamp member of electrical conducting material;

a top clamp member of electrical conducting material;

means detachably affixing said top clamp member to said bottom clamp member in a hinge-like manner;

bolt means for adjustably affixing said top clamp member to said bottom clamp member;

a socket member formed integrally with said bottom clamp member and adapted to receive one end of said conductor cable therein to electrically connect the same to said bottom clamp member;

said bottom clamp member comprising, in combination:

a flat bottom edge;

a first arcuate side edge;

a second arcuate side edge disposed spaced from said first side edge;

a flat top edge disposed adjacentmost said first side edge and extending parallel to said bottom edge;

an intermediate top edge extending parallel to said bottom side edge and spaced closer thereto than said top edge, said intermediate top edge being of a flat configuration extending outwardly of said second arcuate side edge;

a lip formed integrally with said intermediate top edge and having a bottom edge extending parallel to said intermediate top edge;

a bore extending through said lip;

an arcuate semi-circular exterior surface interconnecting the outermost end of said top edge to the outermost end of said first arcuate side edge;

a semi-circular recess interconnecting the innermost end of said top edge to the innermost end of said intermediate top edge, the semi-circular recess being of a size and configuration adapted to fit about the cylindrical side walls of a conventional battery post;

a cylindrical socket forming member having an open front end and a closed back end and cylindrical side walls formed integrally with said bottom edge of said bottom clamp member with said socket having its axis extending parallel thereto and opening out of said open end, said open end being adjacentmost said first arcuate side edge of said bottom clamp member;

a threaded aperture extending radially through a portion of said cylindrical side walls and opening into said socket; and a bolt having a threaded shank threadedly received in said threaded aperture with the terminal end of the bolt adapted to pass into said socket for securing one end of said conductor cable in said socket.

2. The device as set forth in claim 1 wherein said top half of said clamp comprises, in combination:

a lip forming bottom end having a flat bottom surface and a flat top surface;

a bore extending through said lip bottom end between said top and bottom surfaces in position to be axially oriented with said bore of said bottom clamp member lip when said top clamp member is affixed to said bottom clamp member;

a top end including an arcuate exterior surface which curves about and terminates in a hook forming slot portion;

said hook forming slot portion including a flat bottom edge of a size and configuration adapted to engage said flat top edge of said bottom clamp member, and a recess extending between the outermost end of said flat bottom edge and the juncture point with said arcuate exterior surface and being of a curvature complementary to said arcuate semi-circular exterior surface interconnecting the outermost end of said top edge to the outermost end of said first arcuate side edge of said bottom clamp member;

a semi-circular recess of a curvature equal to the curvature of said bottom clamp member recess and interconnecting the innermost end of said lip bottom surface with the innermost end of said hook bottom surface; and whereby said hook portion of said top clamp member is adapted to detachably engage said semi-circular exterior surface of said bottom clamp member to hingedly connect said top clamp member to said bottom clamp member.

3. The device as set forth in claim 2 wherein said bolt means connecting said top clamp member to said bottom clamp member comprises, in combination:

a bolt having a threaded shank with an enlarged head portion formed at one end thereof, said shank adapted to pass axially through the aligned bores in said lips of said top and bottom clamp members with the head of the bolt engaging the exterior surface of one of said lip portions with the terminal end of said bolt projecting beyond the exterior surface of the opposite of said lip portions; and a wing nut detachably threadedly received on said terminal end of said bolt for adjustably securing said top clamp member to said bottom clamp member in a manner varying the effective size of said confronting recesses in said top and bottom clamp members for readily attaching and detaching said clamp device to and from said conventional battery post.

* * * * *